United States Patent [19]

Wilson

[11] Patent Number: 5,003,661

[45] Date of Patent: Apr. 2, 1991

[54] FORCED AIR APPARATUS FOR DIRECTING FILTERED AIR AGAINST A SURFACE

[75] Inventor: Merlin C. Wilson, Charlotte, N.C.

[73] Assignee: Textile Air Company, Inc., Charlotte, N.C.

[21] Appl. No.: 388,999

[22] Filed: Aug. 3, 1989

[51] Int. Cl.[5] ..... A47L 5/14

[52] U.S. Cl. ..... 15/301; 15/316.1; 55/293

[58] Field of Search ..... 55/293; 15/301, 316.1, 15/318.2, 312.1

[56] References Cited

U.S. PATENT DOCUMENTS

| | | | |
|---|---|---|---|
| 956,862 | 5/1910 | Meyer | 55/293 |
| 2,703,152 | 3/1955 | Petersen | 55/293 X |
| 2,766,846 | 10/1956 | Jones | 55/293 |
| 2,845,303 | 7/1958 | King | 15/312.1 X |
| 2,981,644 | 4/1961 | Fain | 15/312.1 X |
| 3,304,570 | 2/1967 | Seress et al. | 15/312.1 |

*Primary Examiner*—Chris K. Moore

*Attorney, Agent, or Firm*—Shefte, Pinckney & Sawyer

[57] ABSTRACT

An apparatus for selectively directing air against surfaces adjacent textile machines to dislodge dust, lint and other textile by-products from such surfaces. The apparatus includes a blower, a support for supporting the blower in a fixed relation to the ceiling above the textile machines, a first air directing assembly for directing the blower air stream in a plane while the assembly is rotated and a second air directing assembly movable in response to rotation of the first air directing assembly to vary the direction of the air stream. Preferably, the first air directing assembly includes a rotating duct portion rotatably mounted in a stationary duct portion of the blower and the second air directing assembly includes a vane pivotally mounted on the rotating duct portion.

11 Claims, 3 Drawing Sheets

FORCED AIR APPARATUS FOR DIRECTING FILTERED AIR AGAINST A SURFACE

BACKGROUND OF THE INVENTION

The present invention relates to an apparatus for directing air against a surface to dislodge material thereon. More particularly, the present invention relates to a blower or fan assembly for mounting on the ceiling of a textile processing area for dislodging dust, lint and other textile by-products that have accumulated on such ceilings over time.

The ceilings of textile work processing rooms often become the resting place of lint, dust and other generally lighter than air by-products created during textile processing. The accumulation of these by-products tends to encourage the further accumulation of by-products thereon, and becomes detrimental to the working environment for the textile processing machines. By far the greatest harm of such by-product accumulation, however, is the creation of a harmful environment for the textile workers who are beset by various respiratory ailments aggravated by the presence of minute airborne lint and other textile by-products.

Accordingly, several types of apparatus have been proposed to deal with these by-product accumulations and one type thereof operates to dislodge such textile by-products from the ceiling and thereby set these by-products with the surrounding air into circulation to eventually be removed by conventional lint-removal devices, such as special filters and the like positioned adjacent the textile processing machines. For example, a universally mounted ceiling cleaner disclosed in U.S. Pat. No. 3,072,321 to King, Jr., includes a high velocity fan and its motor mounted in a fan casing having horizontal trunnions which are mounted in the lower ends of an inverted U-shaped yoke. The fan and its motor oscillate through a vertical swing path relative to the U-shaped yoke. The yoke is rotatably mounted on a hollow vertical shaft which is fixed to the ceiling of a textile processing room. A gear motor unit mounted on the U-shaped yoke drives both the rotation of the yoke and the oscillating motion of the fan and its motor.

However, the ceiling cleaner disclosed in the King, Jr. patent suffers from a number of disadvantages. For example, both the rotational movement the U-shaped yoke and the simultaneous oscillating motion of the fan's motor are ultimately transmitted to the assembly which mounts the ceiling cleaner to the ceiling, thereby subjecting the assembly mounting means to the type of relatively significant torsional forces which occur when a moving object of relatively significant mass, such as the oscillating fan motor, is mounted at a distance from the support means. Additionally, the gear motor must be of sufficient size to rotate the U-shaped yoke with the moving fan and motor supporter thereon as well as to drive the oscillation of the fan and its motor with respect to the yoke and the mass of the gear motor contributes to the strain on the assembly mounting means.

SUMMARY OF THE INVENTION

The present invention provides an apparatus for directing air in a predetermine pattern to clean surfaces in the vicinity of textile machines by dislodging accumulated textile fibers, lint and other textile by-products therefrom, the apparatus including a blower for generating a stream of air, a support for supporting the blower in a substantially fixed disposition relative to the surfaces to be cleaned, a first air directing assembly movable about an axis and communicated with the blower for directing the air stream in a direction parallel to a plane during movement of the first air directing assembly about the axis, a device for moving the first air directing assembly about the axis and a second air directing assembly for selectively changing the direction of the air stream relative to the plane, the second air directing assembly being movable in response to movement of the first air directing assembly about the axis, whereby the air stream is directed in a predetermined pattern to dislodge accumulated fibers, lint and other textile by-products from the surfaces in the vicinity of the textile machines.

The apparatus preferably includes a stationary duct portion communicated with the blower and the first air directing assembly includes a rotating duct portion rotatably mounted on the stationary duct portion and the device for moving the first air directing assembly includes a drive assembly for rotating the rotating duct portion relative to the stationary duct portion about the axis. Additionally, the second air directing assembly preferably includes a vane having an air directing surface and a pivot assembly for pivotably mounting the vane on the rotating duct portion.

According to one aspect of the present invention, the apparatus further includes a cam having a predetermined varying contour connected to the stationary duct portion and a cam follower connected to the vane, the cam follower being adapted to selectively follow the cam during rotation of the rotating duct portion whereby the vane pivots in correspondence to the following action of the cam follower along the cam and the air directing surface of the vane changes the direction of the air stream relative to the plane.

According to one aspect of the present invention, the apparatus includes an air filter mounted to the inlet portion of the blower for selectively permitting the inletting of air and particles beneath a predetermined size into the blower. The air filter preferably has a surface area greater than the cross-sectional area of the inlet portion at which it is mounted and the air filter is movable from a rest position outward of the inlet opening to a position inward of the inlet opening in response to the intake of air into the blower.

Accordingly, the present invention provides an apparatus for dislodging lint and other textile by-products from selected surfaces in a textile processing area which minimizes the torsional and other strain forces exerted upon its mounting assembly. Additionally, the apparatus of the present invention allows the direction and duration of the air stream directed against each surface to be selectively controlled so that those surfaces on which the relatively greatest accumulations of lint and other textile by-products characteristically occur can be subjected to an air stream of sufficient duration to reliably dislodge the by-products therefrom. Moreover, since the blower of the apparatus of the present invention remains stationary with respect to the ceiling to which the apparatus is mounted, the undesirable torsional forces which develop in the prior art devices due to movement of the blower relative to the mounting assembly is eliminated.

DETAILED DESCRIPTION OF THE PREFERRED EMBODIMENTS

During the operation of a textile processing machine, small pieces of the textile material being processed are set free, and they tend to ultimately accumulate together to form lint. Some of the lint, and the by-products of the processing operation, are removed from the air almost immediately by traveling cleaners which operate along paths closely adjacent the textile machines, examples of these traveling cleaners being disclosed in U.S. Pat. No. 4,333,772 to Mulligan, et al; U.S. Pat. No. 4,258,450 to Sohler and U.S. Pat. No. 3,342,130 to Clark, Jr. et al. However, even with the use of the traveling cleaners, and other conventional filtering equipment, some lint eventually accumulates on the ceiling under the influence of various air currents within the textile processing area. As can be understood, some areas of the ceilings tend to accumulate more lint, and other by-products, than other areas of the ceiling.

As can be appreciated, it is desirable to dislodge the accumulated lint on the ceiling and again return the lint to circulation so that it may eventually be engaged and removed by apparatus such as the traveling cleaner apparatus. In fact, practical experience with the considerable volume of lint which in practice accumulates on all surfaces of textile processing areas including the ceiling has shown that such lint is best dislodged by the application of a removal medium, such as blasts of air, on a repeating basis of fairly short duration, for example, at intervals of approximately one minute.

Figure 1:
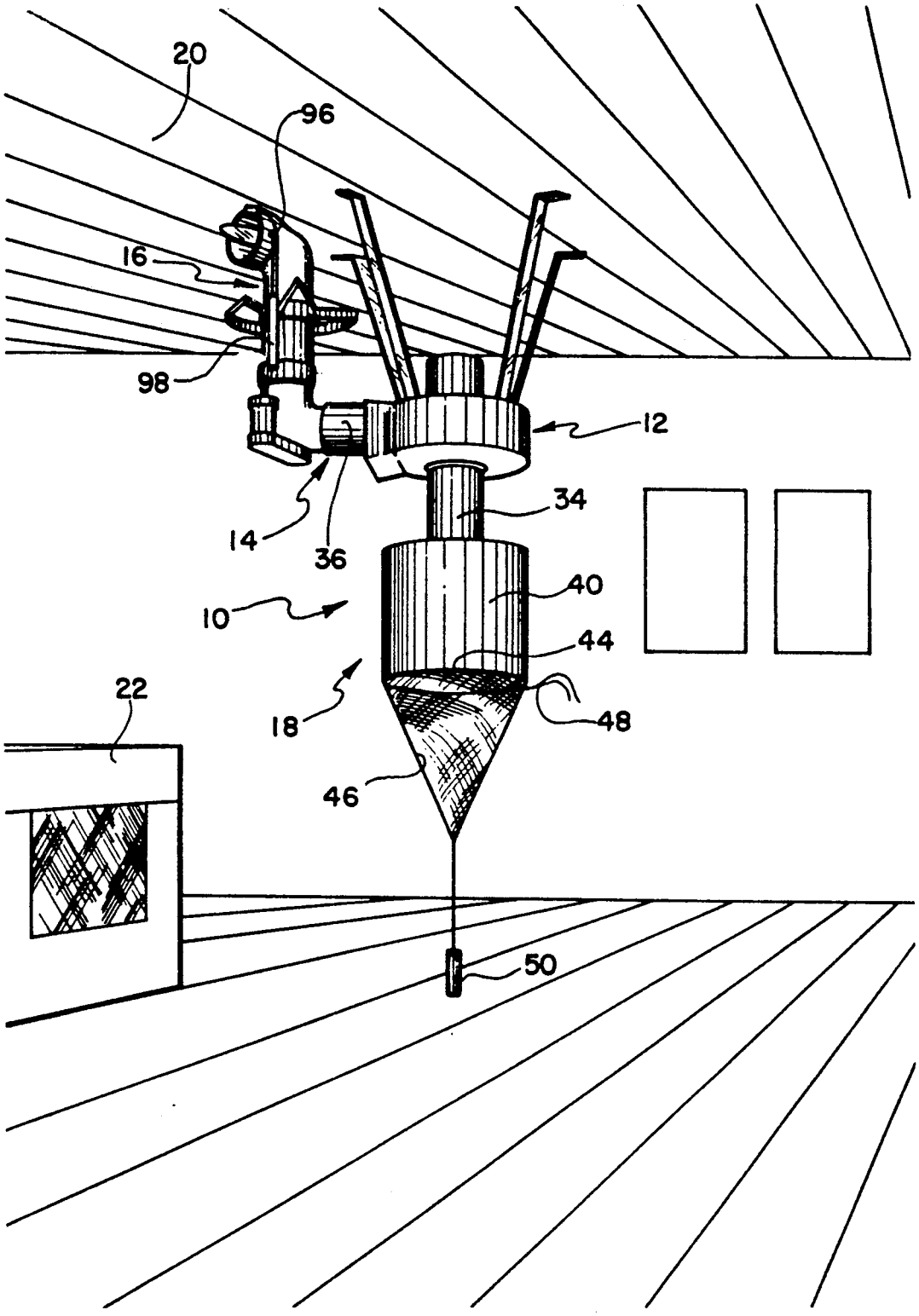
FIG. 1 is a perspective view of one preferred embodiment of the apparatus of the present invention, showing the apparatus installed on the ceiling of a textile processing area and showing the rotating elbow of the apparatus and its associated damper in their respective positions at one point during the operation of the apparatus.

In FIG. 1, one preferred embodiment of the directional air apparatus 10 of present invention is illustrated and includes an air generating blower 12, a connecting subassembly 14, an air directing subassembly 16 and a filter subassembly 18. The directional air apparatus 10 is designed to radially direct a stream of air while continuously changing the axial inclination of the airstream to dislodge lint and other fabric by-products which have accumulated on the ceiling 20 of a textile processing area in which a yarn spinning machine 22 is located.

Figure 2:
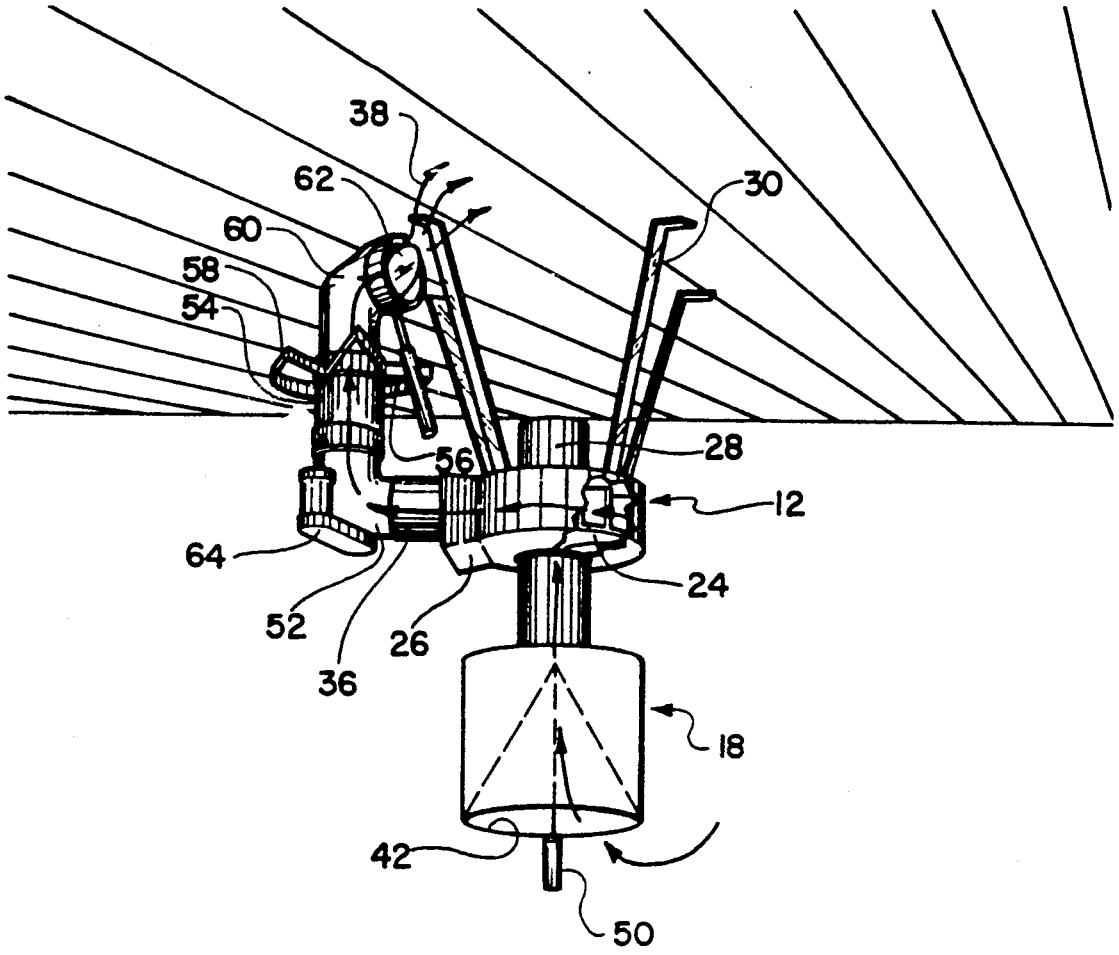
FIG. 2 is a view similar to FIG. 1, showing the respective positions of the rotating elbow and its associated damper of the apparatus at another point during the operation of the apparatus.
Figure 4:
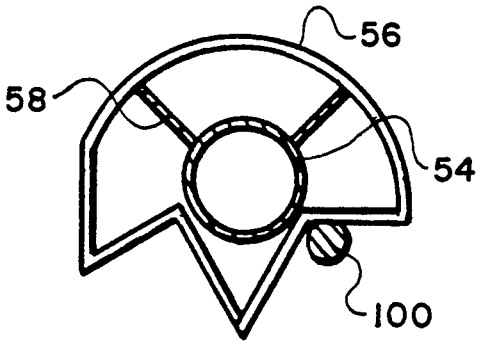
Figure 3:
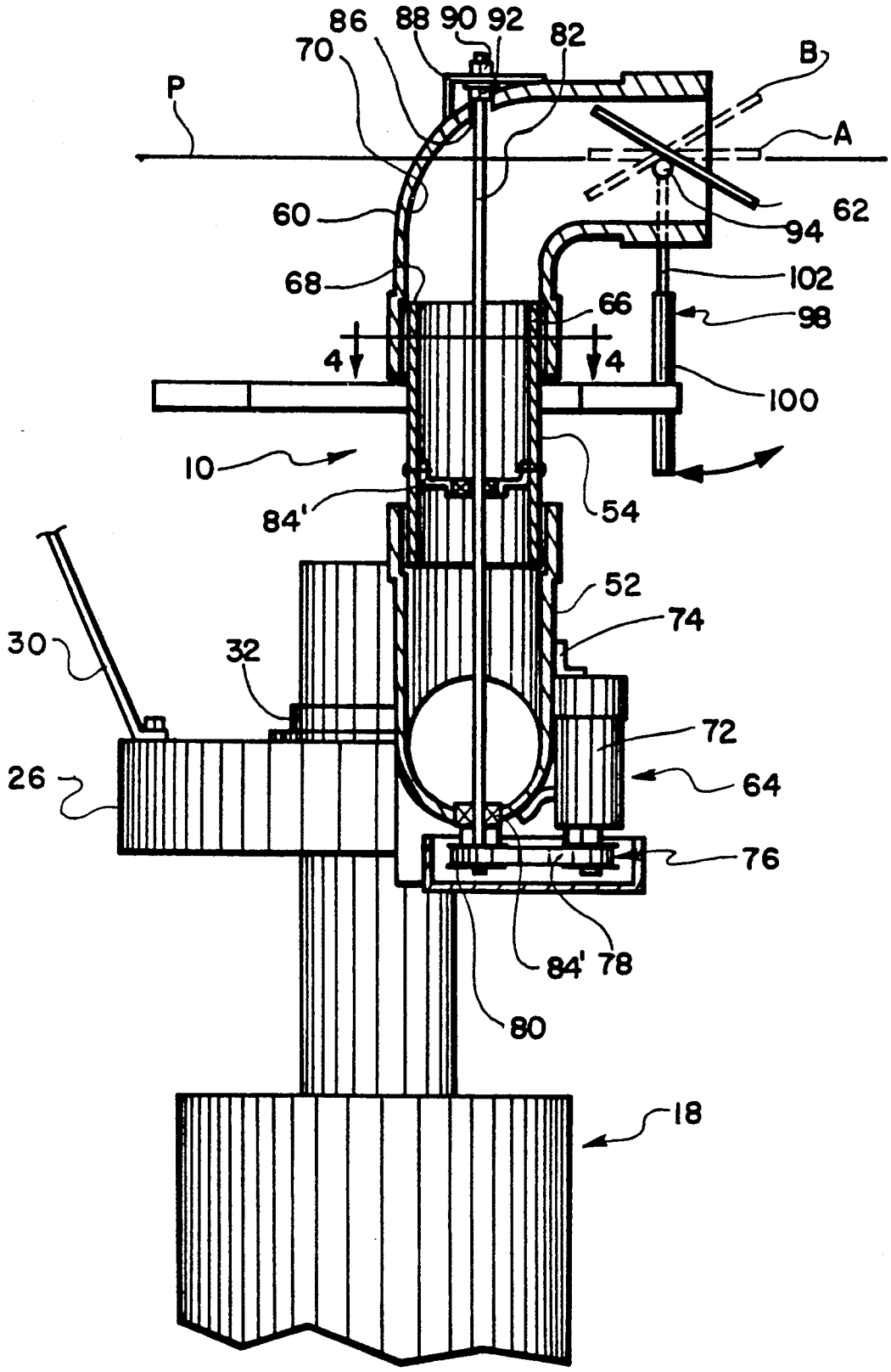
FIG. 3 is a side elevational view in vertical cross-section of the vertical channel, the rotating elbow, the damper and the drive assembly for rotating the rotating elbow of the apparatus shown in FIGS. 1 and 2.

Referring now in more detail to the construction of the directional air apparatus 10, as seen in FIGS. 1, 2 and 3, the air generating subassembly 12 includes an impeller 24 rotatably mounted in a housing 26 and driven by an electric motor 28. The impeller 24, the housing 26 and the electric motor 28 are all of conventional construction and are available commercially as a single unit. A plurality of rigid mounting legs 30, preferably composed of metal or some other durable, rigid material, have flanges which are mounted to the housing 26 and coplanar end portions adapted to be flush mounted to the ceiling 20 so that the directional air apparatus 10 is supported in a suspended disposition from the ceiling. A motor mounting flange 32 is attached to the housing 26 for supporting the motor 28 of the impeller 24. The orientation of the coplanar end portions of the mounting legs 30 relative to the housing 26 is such that, when the directional air apparatus 10 is mounted to the ceiling 20, the impeller 24 rotates in a plane generally parallel to the ceiling 20.

An intake conduit 34 of the housing 26 communicates with the filter subassembly 18 and an outlet conduit 36 of the housing 26 communicates with the connecting subassembly 14. The rotation of the impeller 24 draws air through the filter subassembly 18 into the housing 26, and the drawn in air is propelled as an air stream 38 through the connecting subassembly 14 to the air directing subassembly 16 from which it is selectively directed against the ceiling 20 as described in greater detail below.

The filter subassembly 18 includes an elongate cylindrical portion 40 preferably of larger diameter than the diameter of the impeller 24 and sealingly coupled at one end to the inlet opening of the inlet conduit 34. The other end 42 of the elongate portion 40 is open and includes an annular lip 44. A filter 46, which is preferably of lightweight porous fabric made as a filter medium, is drawn over the annular lip 44 and secured to the elongate portion 40, such as by cinching of a drawstring 48, so that the annular lip 44 resists the pulling of the filter 46 thereover. The filter 46 completely encloses the open end 42 and has a greater surface area than the cross-sectional area of the opening end 42. With the aid of a weight 50 secured to its midpoint, the filter 46 normally extends to some extent axially below the open end 42 when the apparatus 10 is not in operation as shown in FIG. 1. However, the filter 46 is composed of a durable material of sufficient flexibility and lightweightedness to move, under the influence of the air being drawn therethrough during the intake of air by the impeller 24, in the direction of the interior of the elongate portion 40. The permeability of the filter 46 is such that lint and other textile by-product pieces larger than a predetermined size cannot pass therethrough yet sufficient air can pass therethrough to satisfy the intake requirements of the impeller 24.

The communicating subassembly 14 includes an elbow 52 communicating the outlet conduit 36 of the housing 26 with a longitudinal duct 54. The elbow 52 and the longitudinal duct 54 are mounted to the outlet conduit 36 of the housing 26 and can be composed of any conventional duct material such as sheet metal having sufficient rigidity to be both self supporting with respect to the housing 26 and capable of supporting the air directing subassembly 16 thereon.

The air directing subassembly 16 includes a fixed cam track 56 mounted by a plurality of support arms 58 mounted to the periphery of the longitudinal duct 54, a rotating elbow 60, a vane 62 and a drive assembly 64. The rotating elbow 60 includes an annular shoulder 66 compatibly configured with the cylindrical top edge 68 of the longitudinal duct 54 such that the radially extending surface of the shoulder is rotatably supported on the longitudinal duct and the circumferential, axially extending surface of the shoulder has a diameter slightly larger than the outer diameter of the longitudinal duct and extends axially along the longitudinal duct. The rotating elbow 60 includes a channel 70 through which the air stream 38 is discharged from the apparatus 10 in a direction generally parallel to, and slightly below, the ceiling 20.

The elbow drive assembly 64 includes an electric motor 72 mounted to, and laterally of, the longitudinal duct 54 by a bracket 74. A pulley 76 fixedly mounted to the shaft of the motor 72 has a belt 78 trained around it which transmits rotation of the pulley to a driven pulley 80 fixedly mounted to the bottom of a shaft 82. The shaft 82 is rotatably supported in a bearing 84 mounted in the wall of the longitudinal duct 54 and extends generally axially centrally through the longitudinal duct 54 and through a portion of the rotating elbow 60 and extends outside the elbow through an opening 86, which may be sealed if desired. A generally L-shaped flange 88 fixedly mounted to the rotating elbow 60 and overlying the opening 86 includes a bore through which the upper axial end portion of the shaft 82 is received. A nut 90 threaded onto the upper axial portion of the shaft 82 cooperates with a second nut 92 which is threaded onto the shaft 82 on the other side of the L-shaped flange 88 to secure the shaft to the L-shaped flange. A bearing 84' disposed interiorly of the longitudinal duct 54 and at approximately the same axial position as the cam track 56 rotatably supports the shaft 82 and centers it with respect to the longitudinal duct. Accordingly, rotation of the shaft 82 by the motor 72 causes the elbow 60 to rotate about a vertical axis and longitudinal duct 54.

The vane 62 is of generally cylindrical configuration and has a diameter slightly less than the diameter of the channel 70 of the rotating elbow 60. A pivot shaft 94 fixedly mounted to the vane along its diameter is rotatably carried in a pair of diametrically opposite bores 96 (see FIG. 1) in the channel 70 so that the vane 62 can pivot on pivot shaft 94 with respect to the elbow 60. One end of the pivot shaft 94 projects outwardly beyond its respective bearings 96 and has a cam follower member 98 fixedly mounted thereto. The cam follower 98, which includes an engaging portion 100 and a connecting portion 102, is adapted to contact and follow the cam track 56 during the rotation of the rotating elbow 60 on the longitudinal duct 54. The cam track 56 includes a surface having a predetermined contour for controlling the operation of the vane 62 in a manner described shortly below. The bores 96 are disposed in a plane perpendicular to the shaft 82 so that the vane 62 pivots within the channel 70 during the oscillation of the pivot shaft 94 in the bearings 96.

In operation, and in no particular sequence, the electric motor 28 is activated to rotate the impeller 24 and the electric motor 72 is activated to rotate the rotating elbow 60. The rotation of the impeller 24 in the direction indicated by the arrow A in FIG. 2 causes air to be drawn through the filter subassembly 18 into the housing 26. The air being drawn into the filter assembly 18 passes through the filter 46 and the filter 46 moves, under the influence of this incoming air, from the position illustrated in FIG. 1 to the position illustrated by the dashed lines in FIG. 2. Pieces of lint, fabric and other matter entrained in the air entering the elongate cylindrical portion 40 are prevented by the filter 46 from continuing to move with the air toward the impeller 24.

The air drawn into the housing 26 is propelled by the impeller 24 along the airstream 38 into the air directing subassembly 16. The airstream 38 passes through the rotating elbow 60, including its channel 70, and is directed in a direction generally parallel to a plane P which is parallel to the ceiling 20. Simultaneously with the passage of the air stream 38 through the rotating elbow 60, the elbow 60 rotates with respect to the longitudinal duct 54 and thereby causes the cam follower 98 to slide along the cam track 56. Since the cam follower 98 is fixedly connected to the pivot shaft 94, the vane 62 pivots within the channel 70 as the radial spacing of the cam track engaging portion 100 of the cam follower 98 from the shaft 82 varies during its travel along the cam track 56. As seen in FIG. 1, the vane 62 and the cam follower 98 can be set in a predetermined relationship to one another such that, when the engaging portion 100 of the cam follower 98 is at a predetermined radial distance from the axis of the shaft 82, the vane 62 is oriented in the position shown in FIG. 1 at an intersecting orientation to the plane P. Continued rotation of the rotating elbow 60 relative to the longitudinal duct 54 causes the cam follower 98 to slide along the cam track 56 to subsequently reach the position illustrated in FIG. 2 at which the cam track engaging portion 100 of the cam follower 98 has a different radial spacing from the shaft 82 than in FIG. 1. Further rotation of the rotating elbow 60 eventually brings the vane 62 into the position illustrated in FIG. 3 in which it is inclined downwardly with respect to the plane P. Since the cam follower 98 continuously contacts the cam track 56, the radial spacing of the cam track 56 from the shaft 82 at each circumferential position of the cam track determines the radial spacing of the cam follower 98 and, thus, the extent to which the pivot shaft 94 pivots. Since the vane 62 and the pivot shaft 94 are connected in a predetermined orientation to one another, pivoting of the pivot shaft 94 causes a change in the orientation of the vane 62 with respect to the plane P. A s shown in the dotted lines designated A in FIG. 3, the vane 62 is oriented generally parallel to the plane P, and thus the ceiling 20, in its orientation shown in FIG. 1. Additionally, as shown by the dotted lines designated B in FIG. 3, the vane 62 is upwardly inclined with respect to the plane P in its orientation shown in FIG. 2. The solid line position of the vane 62 in FIG. 3 is representative of a downwardly inclined orientation of the vane with respect to the plane P.

Each respective orientation of the vane 62 with respect to the plane P causes the air exiting the channel 70 to be directed against those portions of the ceiling 20 at a selected radial distance from the apparatus 10 and/or a selected vertical distance from the ceiling itself. For example, when the vane 62 is in its generally parallel orientation with respect to the ceiling 20 as shown in FIG. 1, the air exiting the apparatus 10 travels parallel to the ceiling until contacting a surface, such as a ceiling duct, extending from the ceiling or until the air stream dissipates. With the vane 62 in its upwardly inclined orientation with respect to the ceiling 20 as shown in FIG. 2, the air stream 38 is directed against those portions of the ceiling relatively near to the apparatus 10. Contrastingly, with the vane 62 in its downwardly inclined orientation shown in FIG. 3 in solid lines, the air stream 38 is directed downwardly and away from the ceiling 20; this orientation of the vane 62 is useful, for example, for dislodging by-products from the tops of machines or other surfaces disposed at a spacing from the ceiling 20.

The rate of rotation of the rotating elbow 60 and, correspondingly, the rate of change of the orientation of the vane 62 relative to the plane P, is determined by the rate of rotation of the shaft 82 and the contour of the cam track 56. To adjust the rate of rotation of the shaft 82, a number of variables affecting the rate of rotation can be changed such as, for example, by replacing the pulley 76 with a pulley of a different diameter.

As described above, lint and other by-products too large to pass through the filter 46 tend to collect on the filter 46 during suction of air into the filter subassembly 18. Once the electric motor 28 of the impeller 24 is deactivated, the rotation of the impeller decreases and gradually stops and the suction which pulls the filter 46 inside the elongate cylindrical portion 40 also ceases, whereupon the filter 46 is returned to its initial position illustrated in FIG. 1 by the action of the weight 50. If desired, a container can be placed under the filter 46 to collect the lint and other by-products collected on the filter 46 during the operation of the impeller 24 which fall away from the filter upon cessation of the suction or during the downward movement of the filter.

The conical surface of the filter 46 presents a relatively large surface against which the lint and other by-products can be drawn during suction of air through the filter. Moreover, the conical shape insures that there is sufficient clearance between the filter when it is drawn into the filter subassembly 18 and the inner walls of the filter subassembly so that air is drawn through the entire extent of the filter. The conical shape of the filter 46 also beneficially aids in the dislodging of relatively large accumulations of lint or other accumulation, such as cakes of by-products thereon, so that the filter assembly 46 is substantially self cleaning in that the lint accumulations and cakes on its surface are dislodged as the filter changes its configuration during its downward movement out of the filter subassembly 18 under the action of the weight 50. Specifically, the conical shape of the filter 46 is basically inverted as the filter moves from the drawn in position shown in FIG. 2 to its initial position shown in FIG. 1 and this inverting action tends to dislodge the accumulated by-products, such as cakes of by-products, from the filter surface.

The apparatus of the present invention can be adapted with cam tracks of different predetermined contours in accordance with the various cleaning situations which it is desired for the apparatus to handle. Thus, the apparatus offers virtually infinite versatility in the cleaning operations for which it is adapted and this versatility offers particular advantages in view of the wide variety of layouts of textile processing areas, each of which presents its own unique arrangement of surfaces as well as surface portions which particularly tend to accumulate relatively significant accumulations of by-products and which, accordingly, must be subjected to correspondingly longer applications of air to dislodge the by-products therefrom.

The present invention has been described in detail above for purposes of illustration only and is not intended to be limited by this description or otherwise to exclude any variation or equivalent arrangement that would be apparent from, or reasonably suggested by, the foregoing disclosure to one skilled in the art.

I claim:

1. An apparatus for directing air in a predetermined pattern to clean surfaces in the vicinity of textile machines by dislodging accumulated textile fibers, lint and other textile by-products therefrom, comprising:

a blower means for generating a stream of air;

means for supporting said blower means in a substantially fixed disposition relative to the surfaces to be cleaned;

first air directing means movable about an axis and communicated with said blower means for directing said air stream in a direction parallel to a plane during movement of said first air directing means about said axis;

means for moving said first air directing means about said axis; and second air directing means for selectively changing the direction of said air stream relative to said plane, said second air directing means being movable in response to movement of said first air directing means about said axis, whereby said air stream is directed in a predetermined pattern to dislodge accumulated fibers, lint and other textile by-products from the surfaces in the vicinity of the textile machines.

2. An apparatus as claimed in claim 1 and characterized further by a stationary duct portion communicated with said blower means, said first air directing means including a rotating duct portion rotatably mounted on said stationary duct portion and said means for moving said first air directing means including means for rotating said rotating duct portion relative to said stationary duct portion about said axis.

3. An apparatus according to claim 2 and characterized further in that said second air directing means includes vane means having an air directing surface and means for pivotally mounting said vane means on said rotating duct portion.

4. An apparatus according to claim 3 and characterized further by a cam having a predetermined varying contour connected to said stationary duct portion and cam follower means connected to said vane means, said cam follower means being adapted to selectively follow said cam during rotation of said rotating duct portion, whereby said vane means pivots in correspondence to the following action of said cam follower along said cam and said air directing surface of said vane means changes the direction of said air stream relative to said plane.

5. An apparatus according to claim 4 and characterized further in that said means for rotating said rotating duct portion includes a shaft fixedly mounted to said rotating duct portion, a motor and means for drivingly connecting said motor and said shaft for driving rotation of said shaft by said motor whereby said rotating duct portion rotates relative to said stationary duct portion in response to rotation of said shaft.

6. An apparatus according to claim 5 and characterized further in that said cam includes a contoured, continuous surface oriented generally parallel to said axis and disposed in a plane oriented generally transverse to said shaft.

7. An apparatus according to claim 6 and characterized further in that said pivotal mounting means includes a pivot shaft rotatably supported by said rotating duct portion and extending generally diametrically thereacross, and said cam follower means is connected to said pivot shaft for pivoting said pivot shaft about its axis in response to said following action of said cam follower means.

8. An apparatus according to claim 7 and characterized further in that said blower means includes an impeller, an inlet portion for the intake of air for said impeller, said inlet portion having an inlet opening; and an air filtering means mounted to said inlet portion for selectively permitting the inletting of air and particles beneath a predetermined size into said inlet portion.

9. An apparatus according to claim 8 and characterized further in that said air filtering means has a surface area greater than the cross-sectional area of said inlet portion of said blower means at the location at which said air filtering means is mounted thereto, said air filtering means member being movable from a rest position outward of said inlet opening to a position inward of said inlet opening in response to the intake of air into said blower means.

10. An apparatus according to claim 9 and characterized further in that said rotating duct portion includes an annular shoulder compatibly configured with said stationary duct portion and rotatably supported thereon.

11. An apparatus for directing air at a pluality of surfaces, the air being directed for predetermined duration in a predetermined orientation at each surface to dislodge lint and other textile by-products therefrom, comprising:

a blower having an intake portion, a discharge portion and an impeller intermediate the intake and the discharge portion;

means communicated with the blower discharge portion for directing air from the blower at the surfaces in selected predetermined orientations relative to the surface to be cleaned; and means communicated with the blower intake for filtering air entering said blower and accumulating textile by-products thereon during passage of air therethrough, said filter means being movable from a rest position in which it is disposed when said blower is not operating and a filtering position to which it is moved during operation of the blower, and said filter means being adapted to change its configuration during movement between said rest position and said filtering position, whereby the change in configuration of said filter means during movement thereof between said filtering position and said rest position facilitates dislodging of textile by-products accumulated on said filter means.

* * * * *